US008613253B2

(12) United States Patent
Ohmura

(10) Patent No.: US 8,613,253 B2
(45) Date of Patent: Dec. 24, 2013

(54) PRINTING APPARATUS AND METHOD OF INTERMITTENTLY CONVEYING WEB THEREIN

(75) Inventor: Yuuji Ohmura, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 92 days.

(21) Appl. No.: 13/312,345

(22) Filed: Dec. 6, 2011

(65) Prior Publication Data

US 2012/0160117 A1 Jun. 28, 2012

(30) Foreign Application Priority Data

Dec. 24, 2010 (JP) ..... 2010-288709

(51) Int. Cl.
*B41F 13/54* (2006.01)
*B41J 11/42* (2006.01)
*B41J 29/38* (2006.01)

(52) U.S. Cl.
USPC ..... 101/228; 399/384; 399/388; 400/582; 400/583; 347/104

(58) Field of Classification Search
CPC ..... B41J 11/42; B41J 29/38; B41J 2/32; B65H 20/02; B65H 20/04; B65H 23/042
USPC ..... 399/384, 388; 400/582, 583, 611, 400/120.01; 347/104, 215, 216, 218, 221
See application file for complete search history.

(56) References Cited

U.S. PATENT DOCUMENTS 6,592,276 B2 7/2003 Ohba et al.
6,684,051 B2 * 1/2004 Miyamoto et al. ..... 399/384
6,763,220 B2 * 7/2004 Nakazawa ..... 399/401
2003/0177923 A1 * 9/2003 Iwanaga et al. ..... 101/228
2006/0222430 A1 * 10/2006 Duckett et al. ..... 400/583
2010/0002065 A1 * 1/2010 Koyabu ..... 347/215

FOREIGN PATENT DOCUMENTS

JP 11320989 A * 11/1999
JP 2001-335206 12/2001
JP 2002104688 A * 4/2002
JP 2003-94745 4/2003
JP 2004-250203 9/2004
JP 2006-193228 7/2006
JP 2006-248722 9/2006
JP 2007-41370 2/2007
JP 2007-44875 2/2007
JP 2007-186301 7/2007
JP 2009-227396 10/2009

* cited by examiner

*Primary Examiner* — Ren Yan
*Assistant Examiner* — Quang X Nguyen
(74) *Attorney, Agent, or Firm* — Oblon, Spivak, McClelland, Maier & Neustadt, L.L.P.

(57) ABSTRACT

A printing apparatus including: a web conveyance unit that conveys a web; a printing unit that prints an image on the web; a web discharging unit that discharges the web on which the image is formed with the printing unit, the web discharging unit being placed downstream of the printing unit; and a web withdrawal unit that withdraws the web into the printing apparatus, the web withdrawal unit including a web withdrawal roller and at least one pressing roller. When the printing apparatus is in a print waiting state, the printing apparatus drives the web withdrawal roller intermittently, while a pressing force from the at least one of the pressing roller is maintained, so as to convey the web intermittently.

7 Claims, 14 Drawing Sheets

PRINTING APPARATUS AND METHOD OF INTERMITTENTLY CONVEYING WEB THEREIN

BACKGROUND OF THE INVENTION

1. Field of the Invention

Embodiments of the present invention relate to a printing apparatus.

2. Description of the Related Art

Conventionally, in a printing apparatus for forming an image on a web, which is a continuous strip media, for example, the following web conveyance method is known. Namely, pin components of a printer tractor mounted in the printing apparatus are engaged to sprocket holes of the web, and the web is conveyed when the printer tractor is driven. However, when the web having the sprocket holes are used, both end portions of the web having the sprocket holes may be cut after printing. Therefore, the following apparatus has been realized conventionally. Namely, in an apparatus, a web not having the sprocket holes is used. The apparatus conveys the web using a conveyance roller system instead of the printer tractor.

Further, in a field of such a printing apparatus, in order to improve productivity, a demand for faster print speed and a demand for reduction of downtime are increasing. Therefore, the following printing system is more widely used than the box-paper printing in which an operator intervenes every several thousand feet and supplies paper. Namely, a printing system includes a web feeding device located upstream of the printing system. In the printing system, a roll paper that enables continuous printing is used. Here, in the roll paper, several tens of thousands of feet of paper is wound in a roll-like shape.

Conventionally, a printing apparatus including: a control means that controls, before printing, a web conveyance position and a tension on the web on upstream side in a web conveyance direction; and a control means that controls, after printing, a web conveyance position and a tension on the web on downstream side in the web conveyance direction, is known (e.g. Patent Document 1 (Japanese Published Unexamined Publication No. 2001-335206)). Further, a web tension providing device of a printing device that includes: a tension adjusting means for adjusting a tension on a web using pressing forces from a drum and a pressing roller that pinch the web; and a suspending system to visualize whether the tension on the web is strong or weak, is known (e.g. Patent Document 2 (Japanese Published Unexamined Publication No. 2004-250203)).

Further, a printing device including: a tension adjusting guide which operates separately from a tension generating roller so as to provide a suitable tension to various types of webs including a web to which a tension is easily provided and a web to which a tension is not easily provided, is known (e.g. Patent Document 3 (Japanese Published Unexamined Publication No. 2006-248722)). Further, a sheet conveyance device that detects a width of a paper sheet and that separates a tension providing means placed in a region not facing to the paper sheet from a sheet contacting means is known (e.g. Patent Document 4 (Japanese Published Unexamined Publication No. 2009-227396)).

SUMMARY OF THE INVENTION

In one aspect, there is provided a printing apparatus including: a web conveyance unit that conveys a web; a printing unit that prints an image on the web; a web discharging unit that discharges the web on which the image is formed with the printing unit, the web discharging unit being placed downstream of the printing unit; and a web withdrawal unit that withdraws the web into the printing apparatus, the web withdrawal unit including a web withdrawal roller and at least one pressing roller. When the printing apparatus is in a print waiting state, the printing apparatus drives the web withdrawal roller intermittently, while a pressing force from the at least one pressing roller to the web is maintained, so as to convey the web intermittently.

In another aspect, there is provided a method of intermittently conveying a web in a printing apparatus during a print waiting state of the printing apparatus. The printing apparatus includes: a web conveyance unit that conveys a web; a printing unit that prints an image on the web; a web discharging unit that discharges the web, on which the image is formed with the printing unit, the web discharging unit being placed downstream of the printing unit; and a web withdrawal unit that withdraws the web into the printing apparatus, the web withdrawal unit including a web withdrawal roller and at least one pressing roller. Further, the method includes: a step of maintaining a pressing force from the at least one pressing roller to the web; and a step of intermittently driving the web withdrawal roller.

Other objects, features and advantages of the present invention will become more apparent from the following detailed description when read in conjunction with the accompanying drawings.

DETAILED DESCRIPTION OF THE PREFERRED EMBODIMENTS

In the conventional printing apparatuses shown in the above-described Patent Documents 1-4, however, a sufficient conveyance force for pulling and conveying a portion of the web staying between the web feeding device and the printing apparatus may be required, in the web withdrawal system that withdraws the web from the web feeding device. Therefore, a large pressing force from a pressing roller or the like that generates the web conveyance force may be required.

It follows that, when the web is held during a print waiting state, a deformation of a portion of the web, which is pressed by the pressing roller, becomes large as the holding time becomes longer. Thus a dent is generated on the portion of the web. Further, when the print waiting state is terminated and an image is printed on the web, the deformed portion of the web generated in such a way does not contact a transfer drum. Therefore, the image on a surface of the transfer drum is not transferred onto the web, and missing transfer portions (white splotches) arise in the image on the web.

Figure 1:
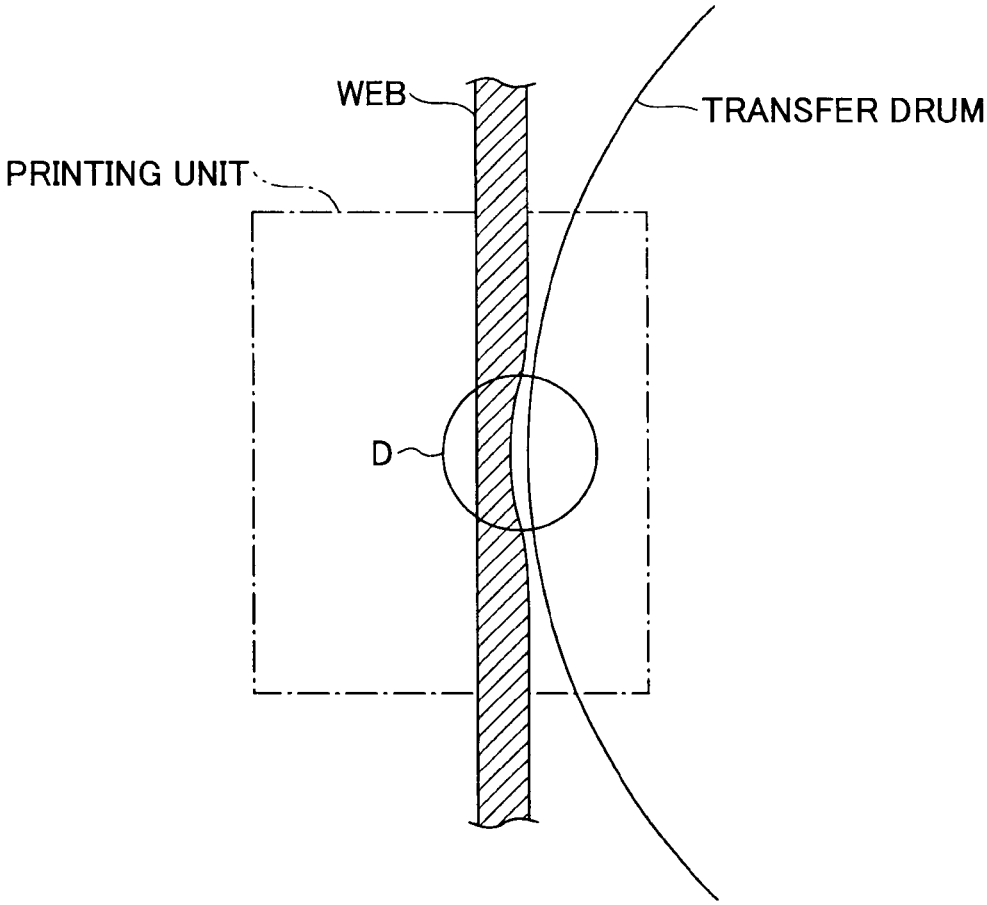
FIG. 1 is a diagram illustrating a contact state in which a web deformed by a pressing roller contacts a transfer drum.

Incidentally, FIG. 1 is a diagram illustrating a contact state in which a web deformed by a pressing roller contacts a transfer drum. As shown in FIG. 1, in a portion D of the web, an arch-shaped dent is generated as a result that the portion D was pressed and deformed by the pressing roller during a print waiting state.

The arch-shaped dent on the web being deformed by the pressing roller does not contact the transfer drum during printing. Thus, an image on the transfer drum is not transferred onto the web, and a missing transfer portion (white splotch) arises in an image on the web. Therefore, printing quality on the web is degraded.

Here, if the pressing roller was released from the web during the print waiting state, a portion of the web 1 being suspended in a web suspending system might be dropped by its own weight and the portion of the web 1 might contact a floor surface and become dirty. In this regard, a pressing force from the pressing roller may be varied depending on a thickness or a type of the web, so as not to generate the deformation on the web. In this case, however, a driving system for varying the pressing force may be required, and this leads to a cost problem.

Embodiments of the present invention are archived in view of the above-described problems. An objective of the embodiments is to provide a printing apparatus that regulates a deformation of a web generated by a pressing roller during a print waiting state, while preventing the web from being dropped, and that reduces degradation of a printing quality.

Hereinafter, embodiments of the present invention are explained in detail.

<Schematic Diagram of Printing Apparatus>

Figure 2:
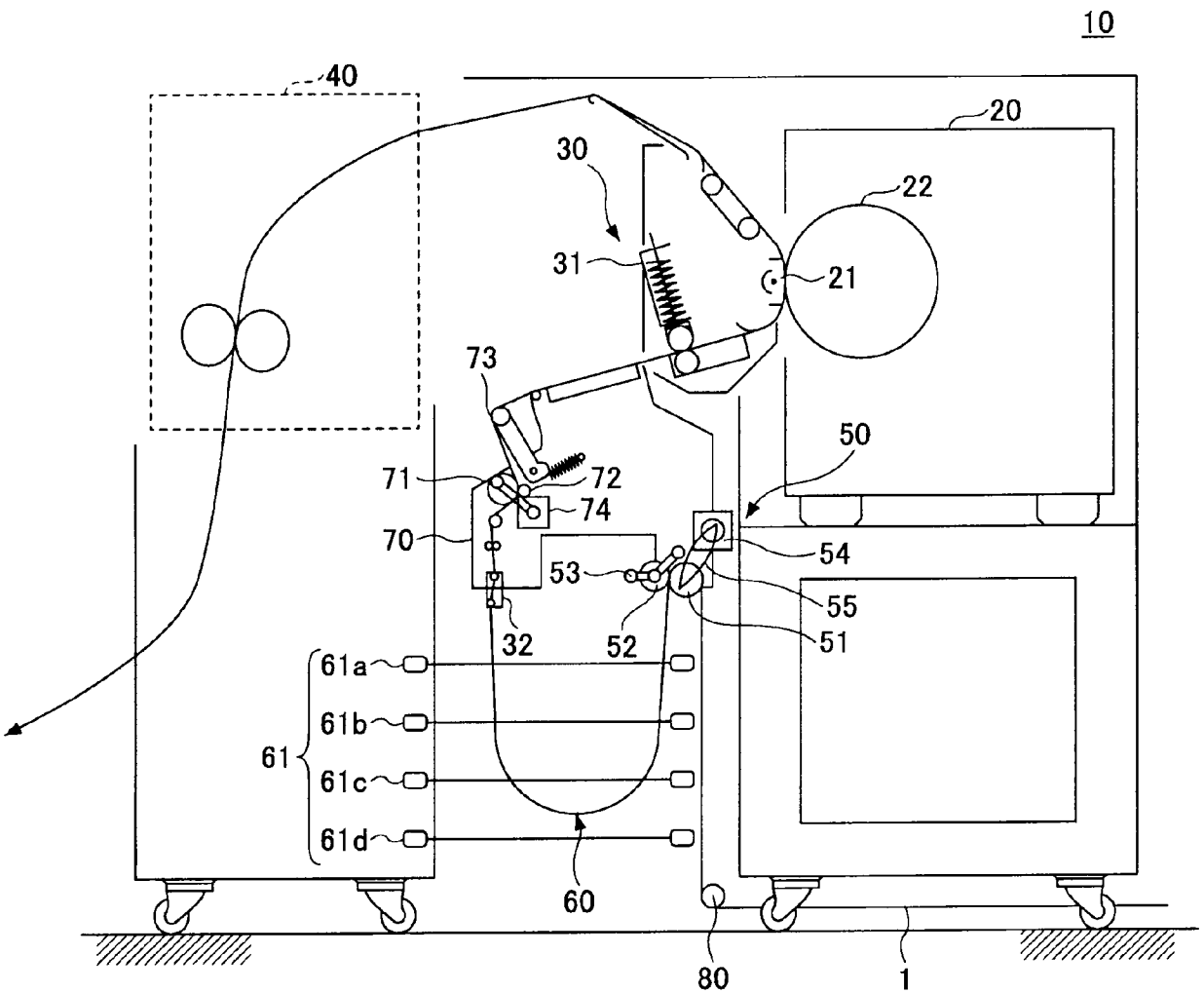
FIG. 2 is a schematic diagram showing a configuration of an embodiment of a printing apparatus.

FIG. 2 is a schematic diagram of a configuration of a printing apparatus according to an embodiment. As shown in FIG. 2, the printing apparatus 10 according to the embodiment includes a printing system 20, a web conveyance system 30, a web discharging system 40, a web withdrawal system 50, a web suspending system 60, a tension generating system 70, and a guide roller 80. Incidentally, in the embodiment, a paper is used as an example of a web 1. However, the embodiment is not limited to this, and, for example, a plastic film may be used.

In the printing apparatus 10 shown in FIG. 2, the printing system 20 includes a printing unit 21 and a transfer drum 22. An image is formed on the web 1, when the web 1 is conveyed to the printing unit 21 and the image on a surface of the transfer drum 22 is transferred onto the web 1. In the example of FIG. 1, a diameter of the transfer drum 22 is about 262 mm.

The web conveyance system 30 includes a web conveyance unit 31 and a web edge guide 32.

The web conveyance unit 31 is, for example, for passing the web 1 through a nip between two rollers and conveying the web 1 to the printing system 20. The web conveyance unit 31 includes an elastic body (e.g. a spring member) for providing a predetermined pressing pressure to the nip between the two rollers.

The web edge guide 32 is arranged downstream of the web suspending system 60. The web edge guide 32 corrects a conveyance position of the web 1 so as to correct meandering of the web 1 in the vicinity of an entrance of the web conveyance system 30. Incidentally, a structure of a guide member of the web edge guide is well-known, and it is disclosed, for example, in Patent Document 1 (Japanese Published Unexamined Application No. 2001-335206).

The web discharging system 40 discharges the web 1 to the outside of the printing apparatus 10. Here, an image has been printed on the web 1 by the printing system 20.

The web withdrawal system 50 includes a web withdrawal roller 51, pressing rollers 52, springs 53, a web withdrawal motor 54, and a timing belt 55. The web withdrawal system 50 withdraws the web 1 from a web feeding device located upstream of the printing apparatus 10.

A rotational speed of the web withdrawal roller 51 is variably controlled by driving of the web withdrawal motor 54, which is connected to the web withdrawal roller 51 through the timing belt 55.

Further, each pressing roller 52 can cause a pressing force (pressing pressure) for maintaining the web 1 to be constant for various types of web 1 whose thicknesses are different from each other. Here, the pressing force for maintaining the web 1 is to prevent the web 1, which is suspended in the web suspending system 60, from being dropped by its own weight.

Further, in the example of FIG. 2, a diameter of the web withdrawal roller 51 is about 48 mm, and a width of the web withdrawal roller 51 is about 529 mm. A diameter of each pressing roller 52 is about 38 mm, and a width of each pressing roller 52 is about 16 mm. Further, since each pressing roller 52 receives about 5 kgf; the width of each pressing roller 52 is about 16 mm; and a length of a missing portion of the transfer printing is about 7 mm, the pressing pressure from each pressing roller 52 is 5 kgf/(16 mm×7 mm)≈4.46 kgf/$cm^2$. Here, the missing portion of the transfer printing occurs because the pressing roller 52 is pressed onto the web 1.

The web suspending system 60 includes a sensor 61 which serves as a means for detecting an amount of the web 1. The web suspending system 60 suspends the web 1 which is withdrawn by the web withdrawal roller 51 so as to stably feed the web 1 to the printing system 20. Further, as the sensor 61 in the embodiment, for example, an optical sensor may be used. Additionally, in the embodiment, plural sensors (4 sensors 61*a*-61*d* in the example of FIG. 2) are arranged at predetermined positions and the sensors detect an amount of a sag of the web 1 (a suspending amount of the web 1). Here, the number of the sensors is not limited to 4. For example, the number may be 1.

The tension generating system 70 includes a tension generating roller 71, a pinch roller 72, a tension guide 73, and a tension roll motor 74. The tension generating system 70 generate a tension for the tension generating roller 71, for example, to suppress the meandering of the web 1 and an occurrence of wrinkles.

The guide roller 80 is a guide roller for guiding the web 1, which is conveyed from the web feeding device located upstream of the printing apparatus 10, to the web withdrawal system 50 through a downside of a chassis of the printing apparatus 10.

<Conveyance Operation for Conveying Web 1 in Printing Apparatus 10>

Hereinafter, a conveyance operation for conveying the web 1 in the above-described printing apparatus 10 is explained. As shown in FIG. 2, the web 1 being conveyed from the web feeding device located upstream of the printing apparatus 10 passes through the downside of the chassis of the printing apparatus 10, and the web 1 is withdrawn to the web suspending system 60 by the web withdrawal roller 51 after passing through the guide roller 80. Then the web 1 is suspended.

The plural pressing rollers 52 are pressed to the web withdrawal roller 51. Here, pressing forces from elastic bodies, such as the springs 53, are applied to the corresponding pressing rollers 52. Thus the withdrawal roller 51 withdraws the web 1. In this manner, the web withdrawal roller 51 generates a conveyance force for conveying the web 1.

The web suspending system 60 detects the amount of the sag of the web 1 using the sensors 61*a*-61*d*. Further, the driving of the web withdrawal motor 54 is controlled depending on results of the detections of the sensors 61*a*-61*d*. In this manner, the rotational speed of the web withdrawal roller 51 connected to the timing belt 55 is adjusted by the driving control of the web withdrawal motor 54. Thus the amount of the sag of the web 1 is maintained to be constant.

Here, an example of the driving control of the web withdrawal motor 54 is explained. The driving control of the web withdrawal motor 54 depends on the amount of the sag of the web 1 obtained from the results of the detections of the sensors 61*a*-61*d*. For example, when the sensor 61*c* detects the web 1, the rotational speed of the web withdrawal roller 51 is reduced. Further, when the sensor 61*c* stops detecting the web 1, the rotational speed of the web withdrawal roller 51 is increased. In this manner, the rotational speed of the web withdrawal roller 51 is controlled, so that the amount of the sag of the web 1 is substantially constant.

The web edge guide 32 corrects the meandering of the web 1 at the neighborhood of the entrance of the web conveyance system 30. Further the tension generating system 70 including the tension generating roller 71 provides a suitable tension to the web 1 so as to suppress the meandering of the web 1 or the occurrence of the wrinkle on the web 1.

In the embodiment, a position of the tension guide 73 is detected by a sensor (which is not shown in the figure). Here, the tension guide 73 has a configuration such that the position of the tension guide 73 varies depending on the tension. The tension roll motor 74 is driven depending on a result of the detection. In this manner, a phase of the tension generating roller 71, which is eccentric, is adjusted.

In the embodiment, for example, when the tension guide 73 detects that the tension of the web 1 is greater than a specified tension, the tension generating roller 71 is controlled to rotate in a direction to reduce a pressing amount of the pinch roller 72, which is supported, for example, by a plate spring. On the other hand, when the tension guide 73 detects that the tension of the web 1 is less than the specified tension, the tension generating roller 71 is controlled to rotate in a direction to increase the pressing amount of the pinch roller 72. In this manner, the tension is controlled so that the position of the tension guide 73 is maintained at a substantially constant position.

As described above, the web 1, to which the suitable tension is provided, is conveyed to the printing unit 21 of the printing system 20 by the web conveyance system 30. After the image is formed on the web 1, the web 1 is discharged to the outside of the printing apparatus 10 by the web discharging system 40.

Next, embodiments of the driving method for driving the web withdrawal roller 51 according to the above-described embodiment are explained using the figures. Incidentally, it is assumed that a time interval t shown in one of the figures for the explanation of one the embodiments described below is the same as each time interval t in the other embodiments described below.

<First Embodiment>

Hereinafter, a driving method of the web withdrawal roller 51 according to a first embodiment is explained using FIGS. 3 and 4.

Figure 3:
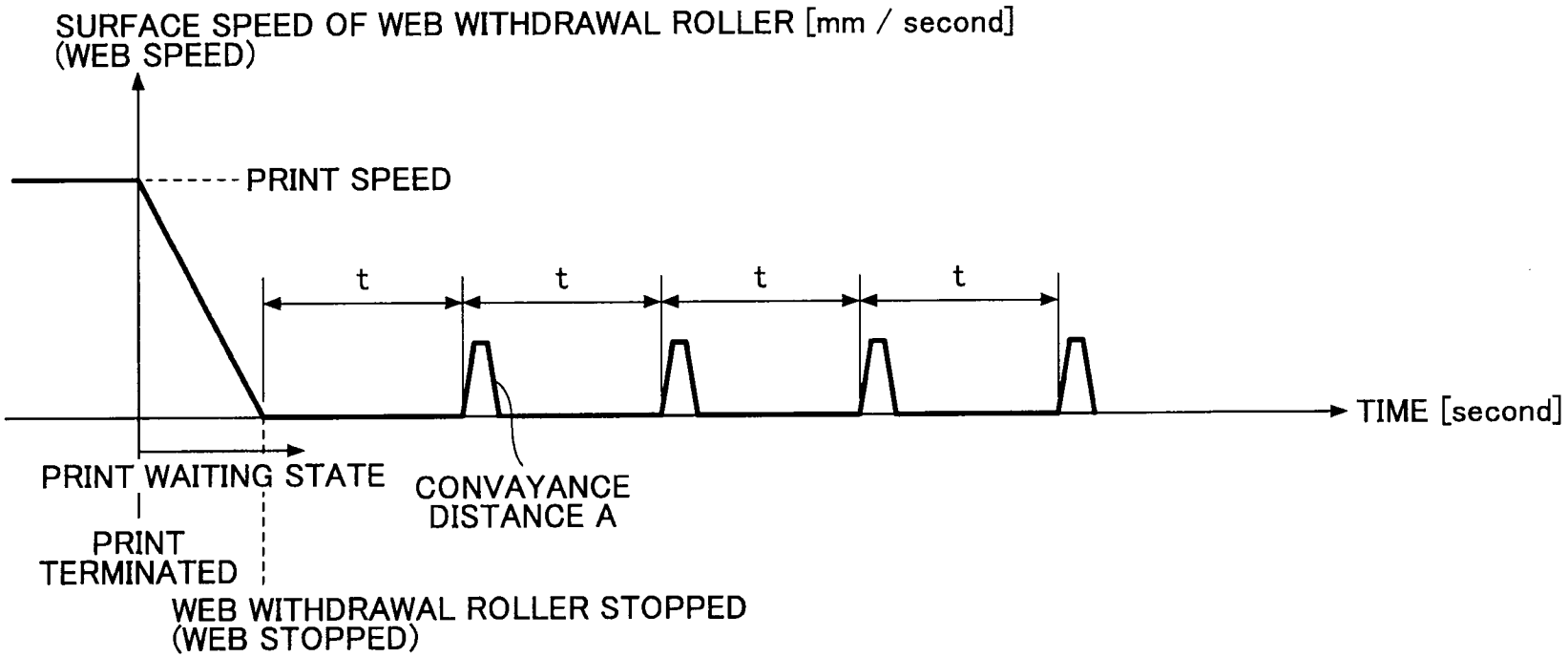
FIG. 3 is a conceptual diagram illustrating a method of driving a web withdrawal roller according to a first embodiment.

FIG. 3 is a conceptual diagram of the driving method of the web withdrawal roller 51 according to the first embodiment. Further, FIG. 4 is a schematic diagram of motions of the web 1 in the web withdrawal system 50 according to the driving method of FIG. 3. Here, the horizontal axis in FIG. 3 indicates a time [second], and the vertical axis in FIG. 3 indicates a surface speed [mm/second] of the web withdrawal roller 51.

Figure 4:
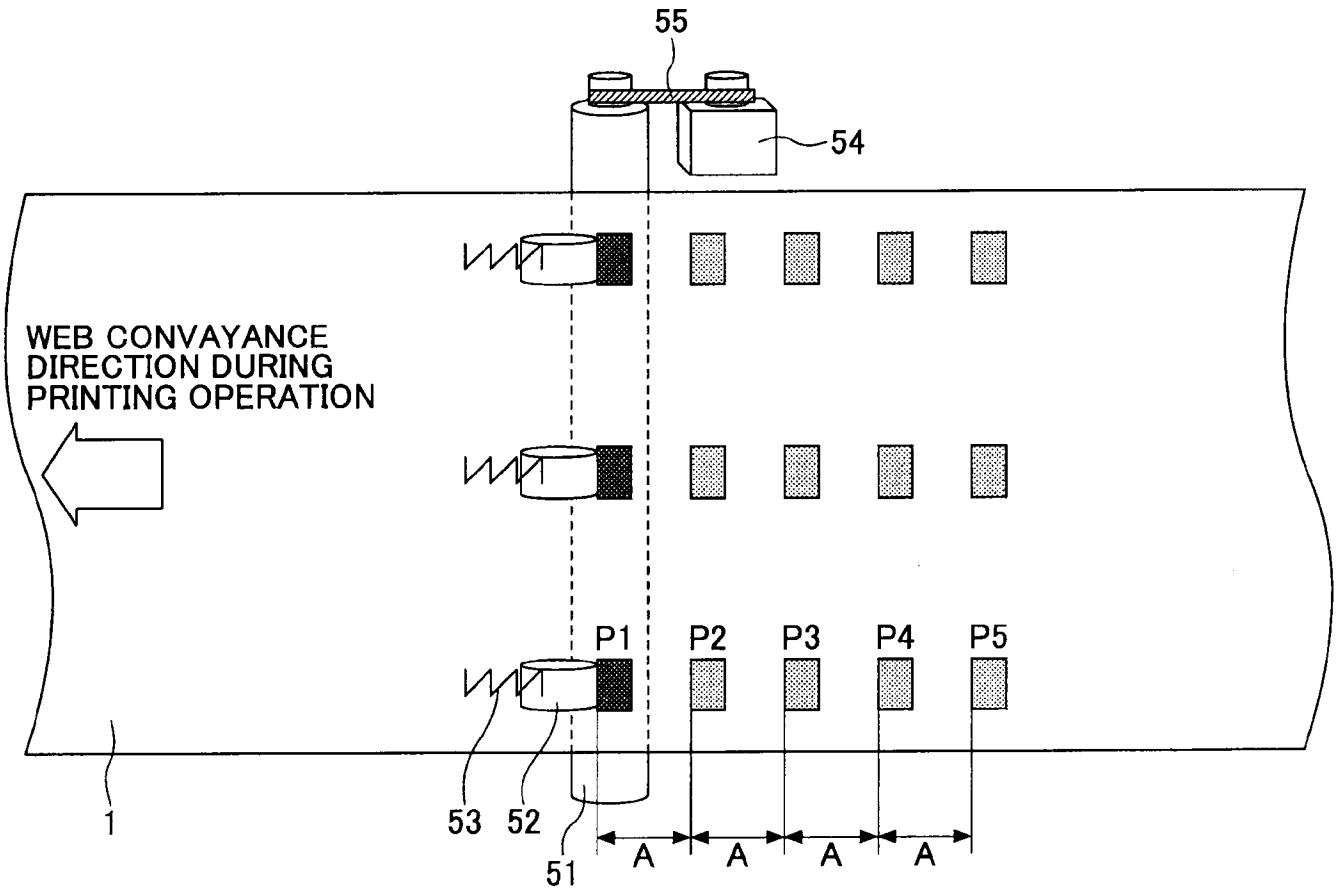
FIG. 4 is a schematic diagram illustrating motions of the web in a web withdrawal system according to the driving method of FIG. 3.

Further, in the example of FIG. 4, a positional relationship between the web 1 on the web withdrawal roller 51 and the pressing rollers 52 is shown. Specifically, the pressing rollers 52 press the web 1 on the web withdrawal roller 51. Here, the springs 53 apply pressing forces to the pressing rollers 52. The web 1 is conveyed by the driving of the web withdrawal roller 51, which is connected to the timing belt 55, when the web withdrawal motor 54 is driven and controlled.

In the example of FIG. 4, the plural pressing rollers 52 (three pressing rollers 52 in the example of FIG. 4) are arranged with respect to the width of the web 1. However, in the first embodiment, the number and the arrangement of the pressing rollers 52 are not limited to this.

In the first embodiment, the surface speed of the web withdrawal roller 51 is almost equal to the conveyance speed of the web 1. For example, the web withdrawal roller 51 conveys the web 1 at a speed that is almost equal to a print speed, so as to maintain the amount of the sag of the web 1 in the web suspending system 60 to be constant.

As shown in FIG. 3, when the printing of the web 1 is terminated, the printing apparatus 10 is in a print waiting state. Then the web withdrawal roller 51 is stopped, and the conveyance of the web 1 is stopped (web 1 is stopped). In the first embodiment, after the printing of the web 1 is terminated and the printing apparatus 10 is in the print waiting state, the web withdrawal roller 51 conveys the web 1 over a conveyance distance A, when, for example, the time t has been passed from the time at which the web withdrawal roller 51 was stopped. After that, as shown in FIG. 3, the web withdrawal roller 51 is controlled and driven, so as to convey the web 1 over the conveyance distance A at every time period t.

In this manner, as shown in FIG. 4, for example, after the printing is terminated (after the state of the printing apparatus 10 is changed to the print waiting state), areas on the web 1 being pressed by the pressing forces of the springs 53 through the pressing rollers 52 move from areas P1 to areas P2, areas P3, and so on, every time the time period t passes. Further, in accordance with the above movements, the web 1 is conveyed in a direction in which the web 1 is conveyed during a usual printing operation.

Further, the conveyance distance A is set to be a distance by which the web withdrawal roller 51 is moved to a position that does not overlap with the pressed surfaces (for example, the areas P1-P5 in FIG. 4), which were previously pressed by the pressing rollers 52. For example, when the web withdrawal roller 51 is placed at a position corresponding to the areas P1, the web withdrawal roller 51 is moved to a position corresponding to the areas P2 that does not overlap with the position corresponding to the areas P1. The conveyance distance A may be a constant distance, so as to simplify the driving control.

Further, the areas P1, the areas P2, the areas P3, and so on of the web 1 are pressed by the pressing rollers 52 for almost t seconds. In this manner, deformation of the web 1 is suppressed in comparison with a case of a conventional printing apparatus in which the time period for the print waiting state is longer than t seconds. Here, an amount of the deformation of the web 1 depends on a time period for which the web 1 is pressed by the pressing rollers 52, a stiffness of the web 1 (ease of deformation), and the pressing forces of the pressing rollers 52. In general, the amount of the deformation of the web 1 becomes larger, as the time period for which the web 1 is pressed becomes longer.

Further, a relationship between the deformed amount of the web 1 and the defects on the transfer of the image onto the web 1 depends on a method of printing in the printing apparatus 10 and a printing capability of the printing apparatus 10. In general, the defects on the transfer of the image onto the web 1 tend to occur, when the amount of the deformation is large. Here, the deformation of the web 1 is allowed, provided that the deformation of the web 1 is within a range where the printing apparatus 10 is able to print normally.

As described above, in the first embodiment, when the printing apparatus 10 is in the print waiting state, the web withdrawal roller 51 is intermittently driven and the web 1 is intermittently conveyed, while the pressing forces from the pressing rollers are maintained. Further, the time period t for the intermittent driving is set to be a value with which the amount of the deformation of the web 1 is regulated within the range where the printing apparatus 10 is able to print normally (for example, a deformed amount of a dent or a concave of the web 1 is within an acceptable range where the transfer of the image onto the web 1 is not adversely affected). In this manner, the occurrence of the defects on the transfer of the image onto the web 1 is suppressed. Therefore, degradation of printing quality can be reduced. Here, the time t for the intermittent driving is determined through an experiment or an evaluation.

<Second Embodiment>

Hereinafter, a driving method of the web withdrawal roller 51 according to a second embodiment is explained using FIGS. 5 and 6. The second embodiment differs from the first embodiment in a point that, during the intermittent driving in the print waiting state of the printing apparatus 10, the web 1 is conveyed in a direction that is opposite to the direction in which the web 1 is conveyed in the usual printing operation.

Figure 5:
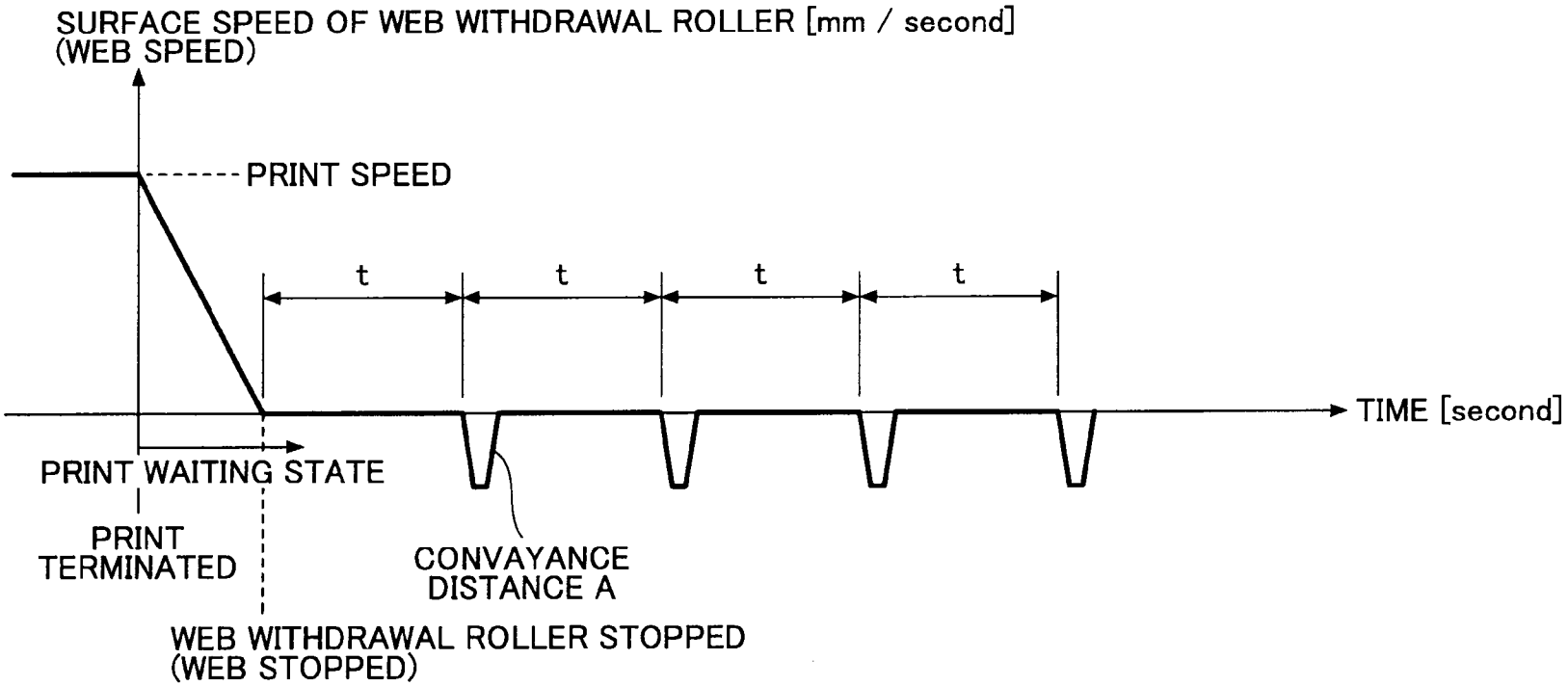
FIG. 5 is a conceptual diagram illustrating a method of driving the web withdrawal roller according to a second embodiment.

FIG. 5 is a conceptual diagram illustrating a method of driving the web withdrawal roller 51 according to the second embodiment. Additionally, FIG. 6 is a schematic diagram illustrating motions of the web 1 in the web withdrawal system 50 according to the driving method of FIG. 6. Here, the horizontal axis in FIG. 5 indicates a time [second], and the vertical axis in FIG. 5 indicates a surface speed [mm/second] of the web withdrawal roller 51.

Figure 6:
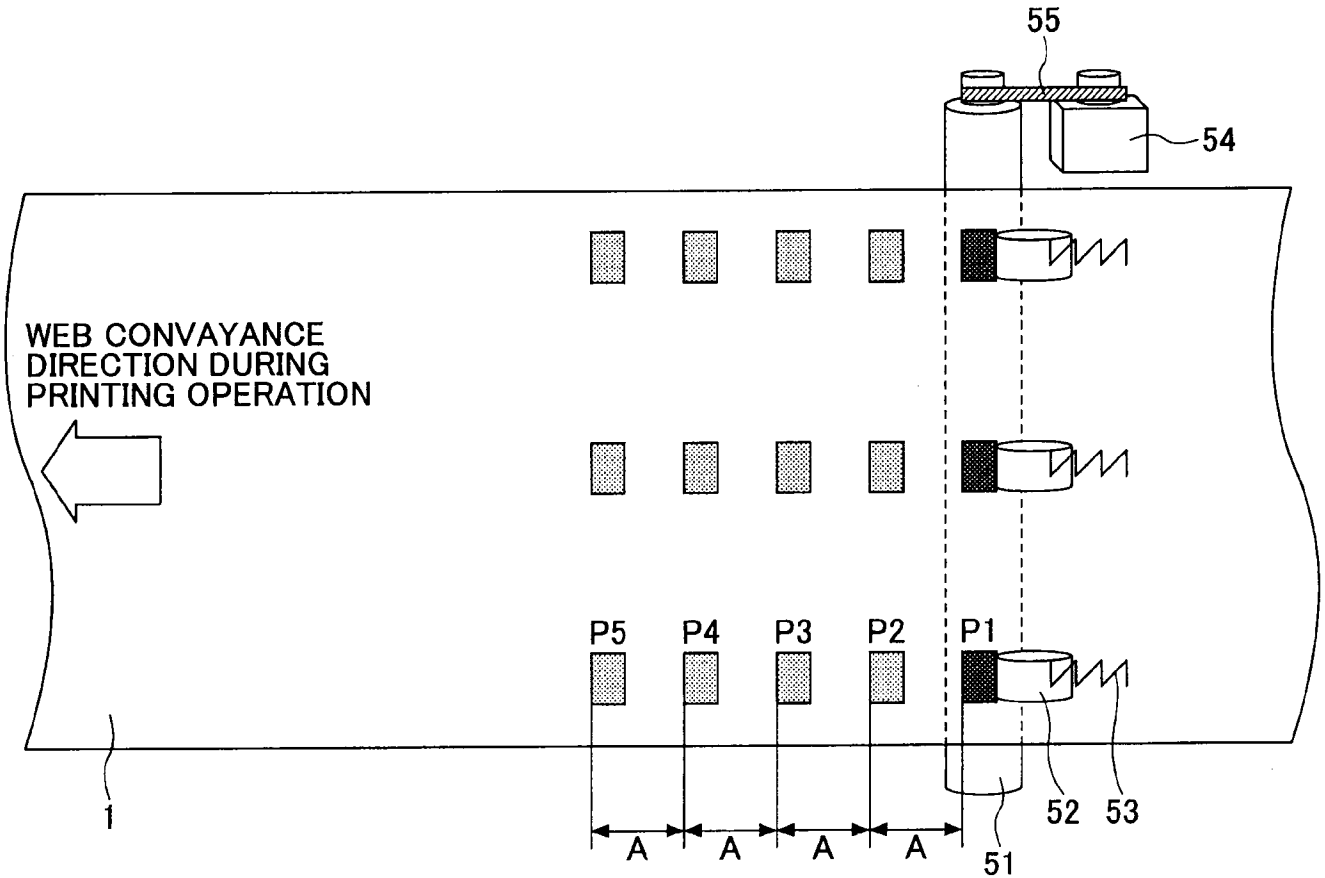
FIG. 6 is a schematic diagram illustrating motions of the web in the web withdrawal system according to the driving method of FIG. 5.

Further, in the example of FIG. 6, a positional relationship between the web 1 on the web withdrawal roller 51 and the pressing rollers 52 is shown, similarly to the first embodiment. In the example of FIG. 6, the three pressing rollers 52 are arranged. However, the second embodiment is not limited to this.

Further, in the example of FIG. 5 of the second embodiment, the surface speed of the web withdrawal roller 51 in the normal printing operation is indicated by a positive value, and the surface speed of the web withdrawal roller 51 during the intermittent driving is indicated by a negative value. This shows that, as shown in FIG. 6, during the intermittent driving, the web withdrawal roller 51 rotates in a direction that is opposite to the direction in which the web 1 is conveyed during the usual printing operation.

Namely, in the second embodiment, after the printing is terminated (after the state of the printing apparatus 10 changes to the print waiting state), the areas on the web 1 being pressed by the pressing forces of the springs 53 through the pressing rollers 52 move from areas P1 to areas P2, areas P3, and so on, every time the time period t passes. In accordance with the above movements, the web 1 is conveyed in the direction that is opposite to the direction in which the web 1 is conveyed during the usual printing operation.

As described above, in the second embodiment, during the intermittent driving, the web 1 is conveyed in the direction which is different from the direction in which the web 1 is conveyed during the usual printing operation. In this manner, the intermittent driving regulates the deformation of the web 1 within the range where the printing apparatus 10 is able to print normally. Further the occurrence of the defects on the transfer of the image onto the web 1 is suppressed by the intermittent driving. Therefore, the degradation of the printing quality can be reduced.

<Third Embodiment>

Hereinafter, a driving method of the web withdrawal roller 51 according to a third embodiment is explained using FIGS. 7A and 7B. The third embodiment differs from the first embodiment in a point that, during the intermittent driving in the print waiting state of the printing apparatus 10, the web 1 is conveyed in plural directions including the direction in which the web 1 is conveyed in the usual printing operation (forward direction) and the direction opposite to the direction in which the web 1 is conveyed in the usual printing operation (opposite direction).

Figure 7A:
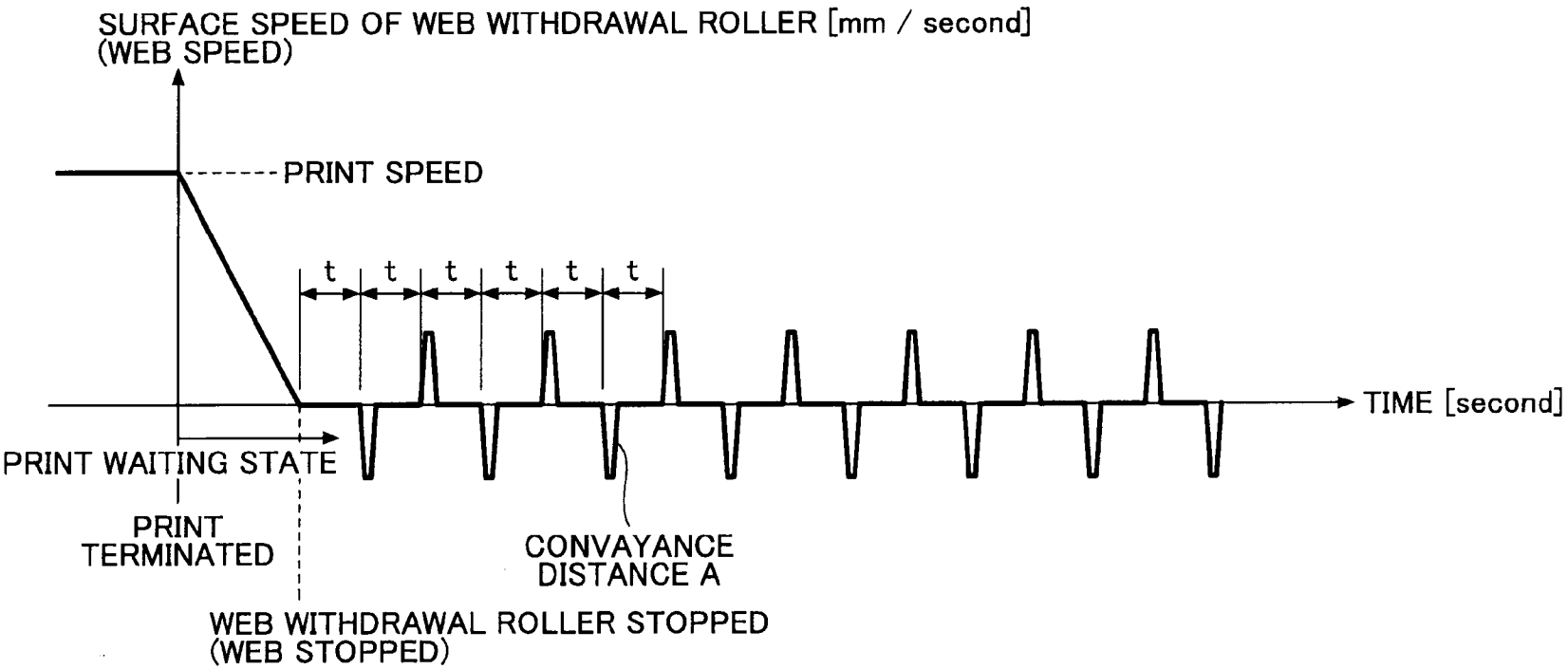
FIGS. 7A and 7B are conceptual diagrams illustrating a method of driving the web withdrawal roller according to a third embodiment.
Figure 7B:
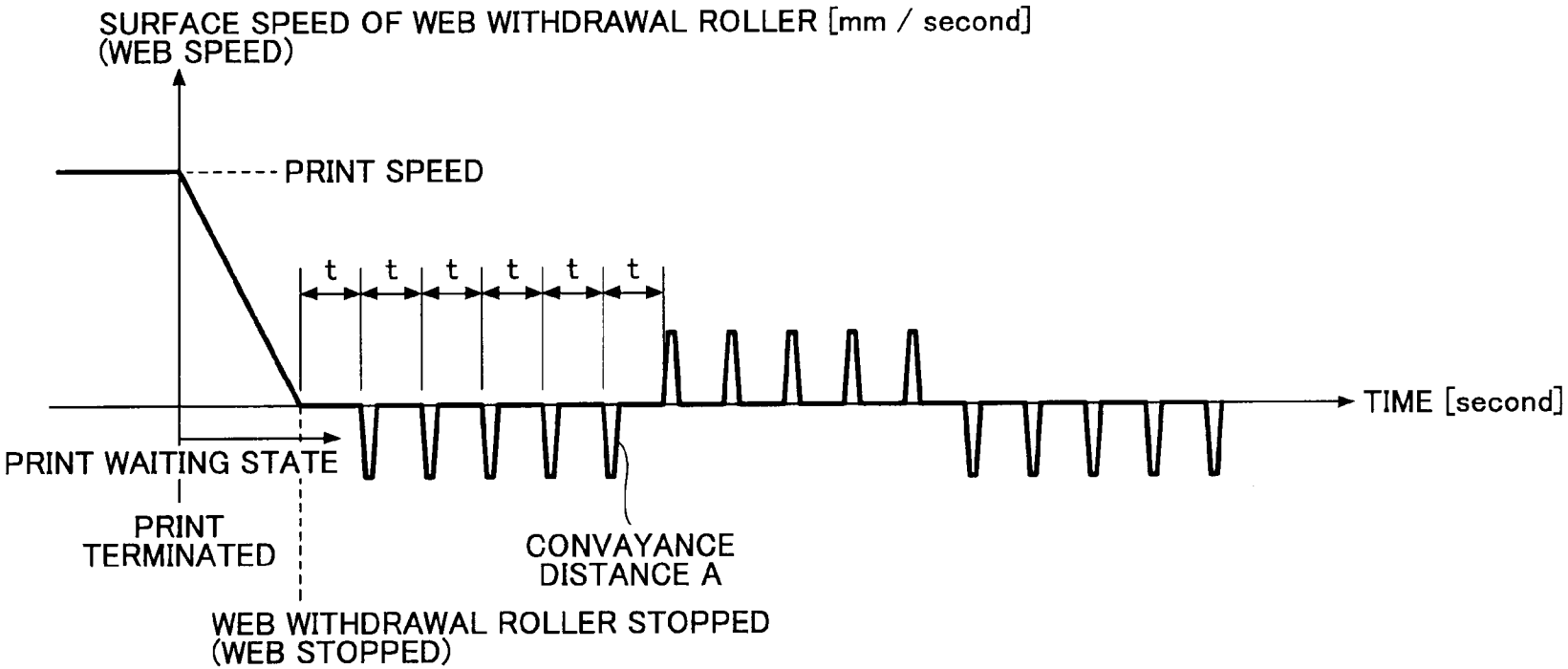

FIGS. 7A and 7B are conceptual diagrams illustrating a method of driving the web withdrawal roller 51 according to the third embodiment. In each of FIGS. 7A and 7B, the horizontal axis indicates a time [second], and the vertical axis indicates a surface speed [mm/second] of the web withdrawal roller 51.

As described above, the intermittent driving of the web withdrawal roller 51 during the print waiting state of the printing apparatus 10 can regulate the amount of the deformation of the web 1 within a range where the printing apparatus 10 is able to print normally. Additionally, the occurrence of the defects on the transfer of the image onto the web 1 can be suppressed by the intermittent driving. Therefore, as shown in FIGS. 7A and 7B, in the third embodiment, the following driving methods are used. Namely, in each driving method, the directions in which the web 1 is conveyed are a combination of the forward directions and the reverse directions.

In the driving method in FIG. 7A, there are two portions at which the pressing rollers 52 press the web 1. The web withdrawal roller 51 moves back and forth between the two portions every time the time t passes. In this case, since the same portions are pressed repeatedly, the amount of the deformation of the web 1 may be greater in comparison to the cases of the first embodiment and the second embodiment, in which each portion is pressed only once.

However, in the driving method in FIG. 7A, one of two pressed portions of the web 1 is not pressed for the time period t, during one cycle of the movement of the web withdrawal roller 51. Therefore, the deformation of the one of the two pressed portions of the web 1 is recovered during the time period t. Namely, the time period t for the intermittent driving is set to be an acceptable time period within which only deformations (e.g. a dent or a concave part) that do not adversely affect the transfer of the image onto the web 1 may occur. Further, in FIG. 7A, 2×t seconds is set to be a time period, during which the deformations at the pressing surfaces of the pressing rollers 52 almost recover to the original surfaces. Thus, the deformed web 1 is in a state in which the original surface is recovered.

Further, the amount of the deformation of the web 1 per one pressing may be reduced by setting the value of the time period of t seconds to be shorter than that of the driving methods in FIGS. 3 and 5.

As described above, in the driving method shown in FIG. 7A, the amount of the deformation of the web 1 is regulated within the range where the printing apparatus 10 is able to print normally, while the amount of the displacement (conveyance distance) of the web 1 is minimized. Here, the web 1 is held at the web withdrawal system 50 during the print waiting state of the printing apparatus 10. In this manner, the occurrence of the defects on the transfer of the image onto the web 1 is suppressed. Therefore, the degradation of printing quality can be reduced.

Further, FIG. 7B shows the driving method in which the following reciprocal motions are repeated. Namely, in each reciprocal motion, the web 1 is forwarded 5 times in the forward direction, and, after that, the web 1 is moved back 5 times in the opposite direction. In this manner, for example, when an area of the web 1 which can be used for the intermittent driving is limited, the conveyance distance A, over which the web 1 is conveyed each time during the intermittent driving, and the number of times the web 1 is conveyed in the same direction (5 times in the example of FIG. 7B) may be set in advance.

Further, in the above-described intermittent driving, the following number of times to press the web 1 per one cycle may be determined in advance through an experiment. The number of times to press the web 1 is such that a deformation that adversely affects the transfer of the image on the web 1 occurs when the pressing of t seconds is applied the number of times to the web 1. For example, when it is determined that the deformation is not recovered within 2×t seconds, three portions on the web 1 may be repeatedly pressed. In this case, after 3×t seconds from the time when the web 1 was pressed, the web 1 is in a state in which the deformation is recovered. In this manner, web 1 may be conveyed in the combined directions in which the forward directions and the opposite directions are combined. Alternatively, only one of the above-described driving methods in FIG. 3 and FIG. 5 may be used. Further, the driving methods in the first embodiment and the second embodiment may be combined and used.

As described above, in the third embodiment, the amount of the deformation of the web 1 is regulated within the range where the printing apparatus 10 is able to print normally, while the web 1 is moved within the area which can be used for the intermittent driving. In this manner, the occurrence of the defects on the transfer of the image onto the web 1 is suppressed. Therefore, the degradation of the printing quality can be reduced.

<Fourth Embodiment>

Hereinafter, a driving method of the web withdrawal roller 51 according to a fourth embodiment is explained using FIGS. 8 and 9. The fourth embodiment differs from the first embodiment in a point that, during the intermittent driving in the print waiting state of the printing apparatus 10, a conveyance direction and a conveyance distance of the web 1 are defined by combinations of various conveyance directions and various conveyance distances.

Figure 8:
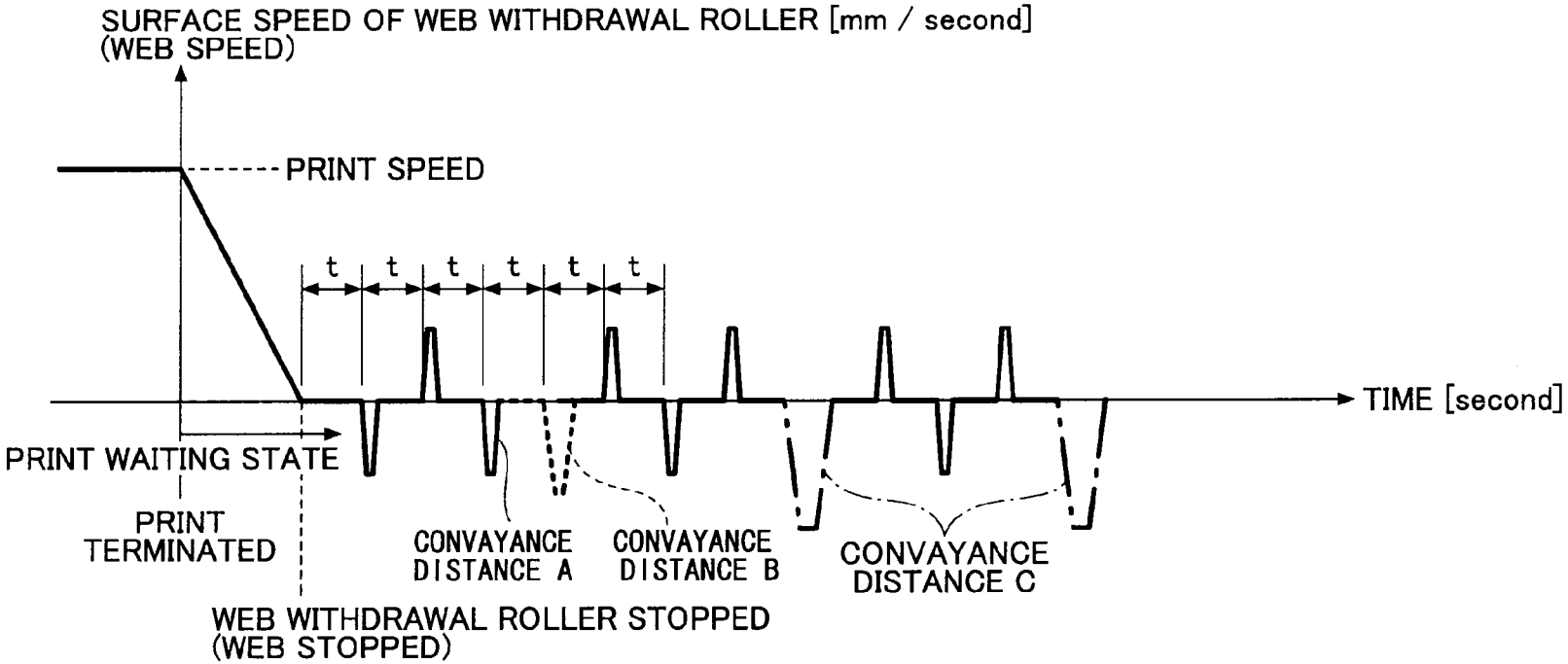
FIG. 8 is a conceptual diagram illustrating a method of driving the web withdrawal roller according to a fourth embodiment.
Figure 9:
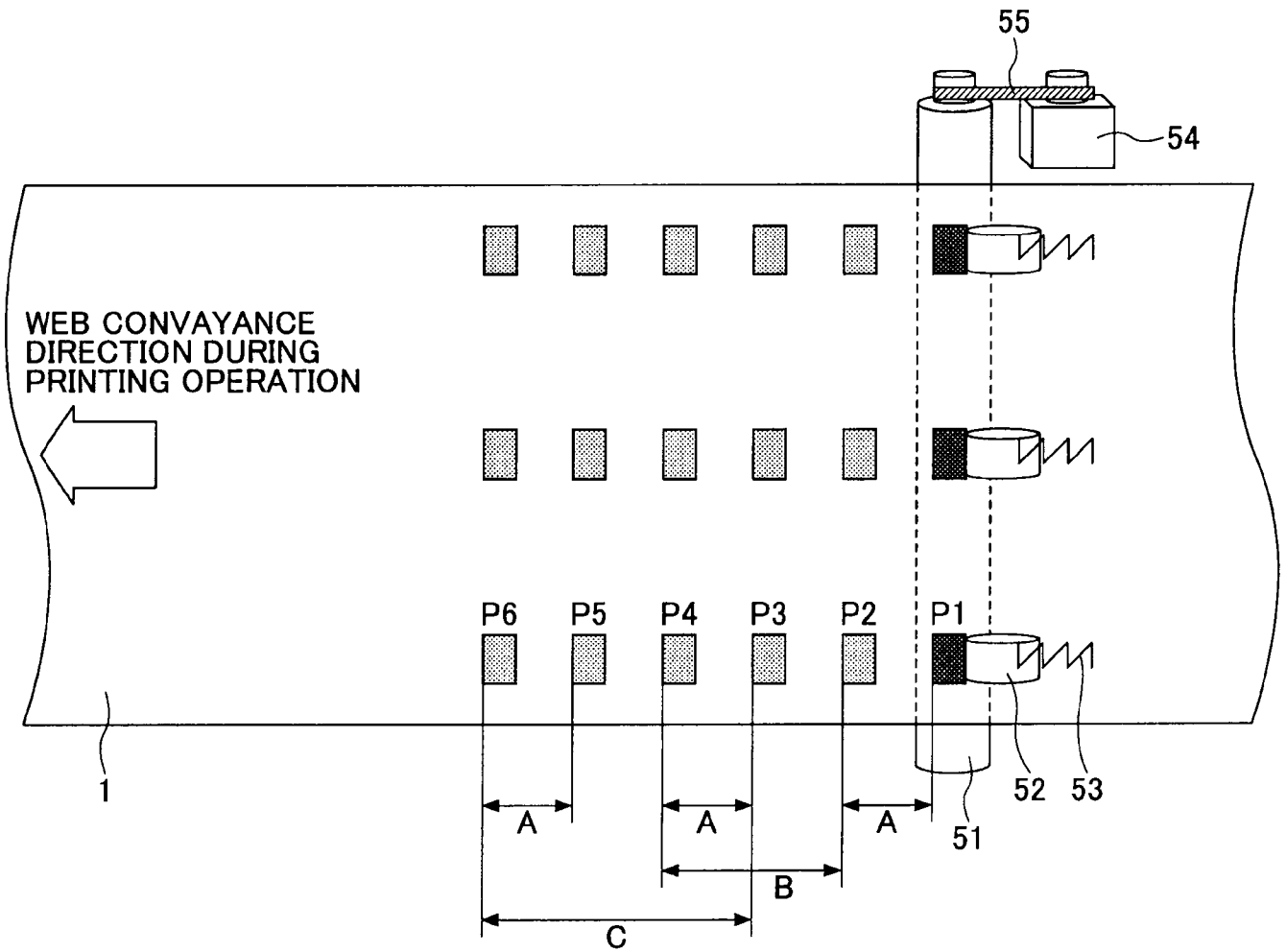
FIG. 9 is a schematic diagram illustrating motions of the web in the web withdrawal system according to the driving method of FIG. 8.

FIG. 8 is a conceptual diagram illustrating the driving method of the web withdrawal roller 51 according to the fourth embodiment. FIG. 9 is a schematic diagram illustrating motions of the web 1 in the web withdrawal system 50 according to the driving method of FIG. 8. Here, the horizontal axis in FIG. 8 indicates a time [second], and the vertical axis in FIG. 8 indicates a surface speed [mm/second] of the web withdrawal roller 51. Further, in the example of FIG. 9, a positional relationship between the web 1 on the web withdrawal roller 51 and the pressing rollers 52 is shown, similarly to the above embodiments. In the example of FIG. 9, the three pressing rollers 52 are used. However, the fourth embodiment is not limited to this.

In the driving method shown in FIG. 8, the following driving directions are indicated. Namely, t seconds after the web 1 is stopped, the web 1 is conveyed in the opposite direction over the conveyance distance A; subsequently, t seconds after that, the web 1 is conveyed in the forward direction over the conveyance distance A; subsequently, t seconds after that, the web 1 is conveyed in the opposite direction over the conveyance distance A; subsequently, t seconds after that, the web 1 is conveyed in the opposite direction over the conveyance distance B which is different from the conveyance distance A; subsequently, the web 1 is conveyed in the forward direction over the conveyance distance A, the web 1 is conveyed in the opposite direction over the conveyance distance A, and the web 1 is conveyed in the forward direction over the conveyance distance A; and, further, the web 1 is conveyed in the opposite direction over the conveyance distance C which is different from the conveyance distances A and B.

The driving method shown in FIG. 8 can be explained in the following manner in FIG. 9. Namely, the areas of the web 1 being pressed by the pressing rollers 52 are displaced as follows:

P1→P2→P1→P2→P4→P3→P4→P3→P6→P5→P6→P5.

As described above, in the fourth embodiment, motions of the web 1 during the intermittent driving can be varied by setting the sending directions (conveyance directions) and the conveyance distances of the web 1. Here, the amount of the deformation of the web 1 is regulated within the range where the printing apparatus 10 is able to print normally and the occurrence of the defects on the transfer of the image onto the web 1 can be suppressed, provided that the value of the time period t of the intermittent driving does not exceed a defined value. Therefore, the degradation of the printing quality can be reduced.

<Trigger of Inversion of Conveyance Direction>

Here, in the driving patterns during the intermittent driving in the above-described embodiments, a trigger to invert the conveyance direction of the web 1 from the conveyance direction during the usual printing operation (for example, a positive direction) to the direction opposite to the conveyance direction during the usual printing operation (for example, a negative direction), or, a trigger to invert the conveyance direction of the web 1 from the negative direction to the positive direction may be defined in advance by using the number of times to press the web 1, as shown in FIGS. 7 and 8. Further, the above-described inversions of the conveyance direction from the positive direction to the negative direction and from the negative direction to the positive direction (the triggers of the inversions) can be determined by detecting the amount of the displacement of the web 1 with the sensors 61.

For example, in the above described web suspending system 60 in FIG. 2, when the web 1 is conveyed in the positive direction beyond the position of the sensor 61*d*, the web 1 reaches to a floor surface and the web 1 becomes dirty. Further, when the web 1 is conveyed in the negative direction above the position of the sensor 61*a*, the web 1 suspended in the web suspending system 60 runs short, and the web 1 is pulled. Thus, there is a possibility that the web 1 breaks.

Therefore, for example, when the sensor 61*d* detects the web 1, the direction of the rotation of the intermittent driving of the web withdrawal roller 51 in the print waiting state of the printing apparatus 10 is switched from the positive direction to the negative direction. Further, when the sensor 61*a* detects the web 1, the direction of the rotation of the intermittent driving of the web withdrawal roller 51 in the print waiting state of the printing apparatus 10 is switched from the negative direction to the positive direction. In this manner, for example, even if there are differences in the sagging shapes in the web suspending system 60 depending on the differences in the stiffness of the web 1, the web 1 can be conveyed, while the range that can be used for the intermittent driving of the web 1 is maximized.

Incidentally, the triggers of the inversions of the conveyance directions of the web 1 in the embodiments are not limited to the above-described switching method of the web withdrawal roller 51 using the detection results of the sensors 61. Further, in the embodiments, the detecting positions of the sensors 61, the detection method, and the determination method of the direction of the rotation of the intermittent driving using the detection result of the sensors 61 are not limited the above-described switching method.

<Termination of Intermittent Driving During Print Waiting State>

Incidentally, when the intermittent driving of the web withdrawal roller 51 in the print waiting state of the printing apparatus 10 is always continued during the print waiting state of the printing apparatus 10, a driving current flowing through the web withdrawal motor 54 may be required every t seconds. For example, when the power is on and the printing is not performed for a long time, an unnecessary power may be consumed by repeating the intermittent driving.

Therefore, for example, the intermittent driving of the web withdrawal roller 51 during the print waiting state of the printing apparatus 1 may be set so as to be terminated at a time when a predetermined time is elapsed from the time when the state of the printing apparatus 10 was changed to the print waiting state. For example, using the one hour, which may be a time interval of a break, as a reference, the intermittent driving is terminated when an elapsed time from the time when the state of the printing apparatus 10 was changed to the print waiting state is greater than or equal to one hour. In this manner, for example, when the printing operation is terminated during nighttime, the unnecessary power consumption can be cut down. Further, as described below, for example, the printing apparatus 10 of the embodiment may include a controller or an input setting unit, and the user may set the above-described setting using the controller or the input setting unit, prior to or during the operation of the printing apparatus 10.

Usually, when the printing operation is terminated for a long time as described above, a test printing for confirming a print condition is performed at a start time of the next printing. In the test printing, the portion of the web 1 on which the pressing rollers 52 had been held is used for the test printing. Therefore, when the printing operation is terminated for a long time, the deformation of the web 1 by the pressing rollers 52 and the defects on the transfer of the image on the web 1 are not deemed as problems.

As described above, the determination (trigger) to terminate the intermittent driving during the print waiting state of the printing apparatus 10 may be made through the setting being made in advance based on the elapsed time. Alternatively, for example, the determination may be triggered by the detection of the suspended amount of the web 1 in the web suspending system 60 with the sensors 61.

Figure 10:
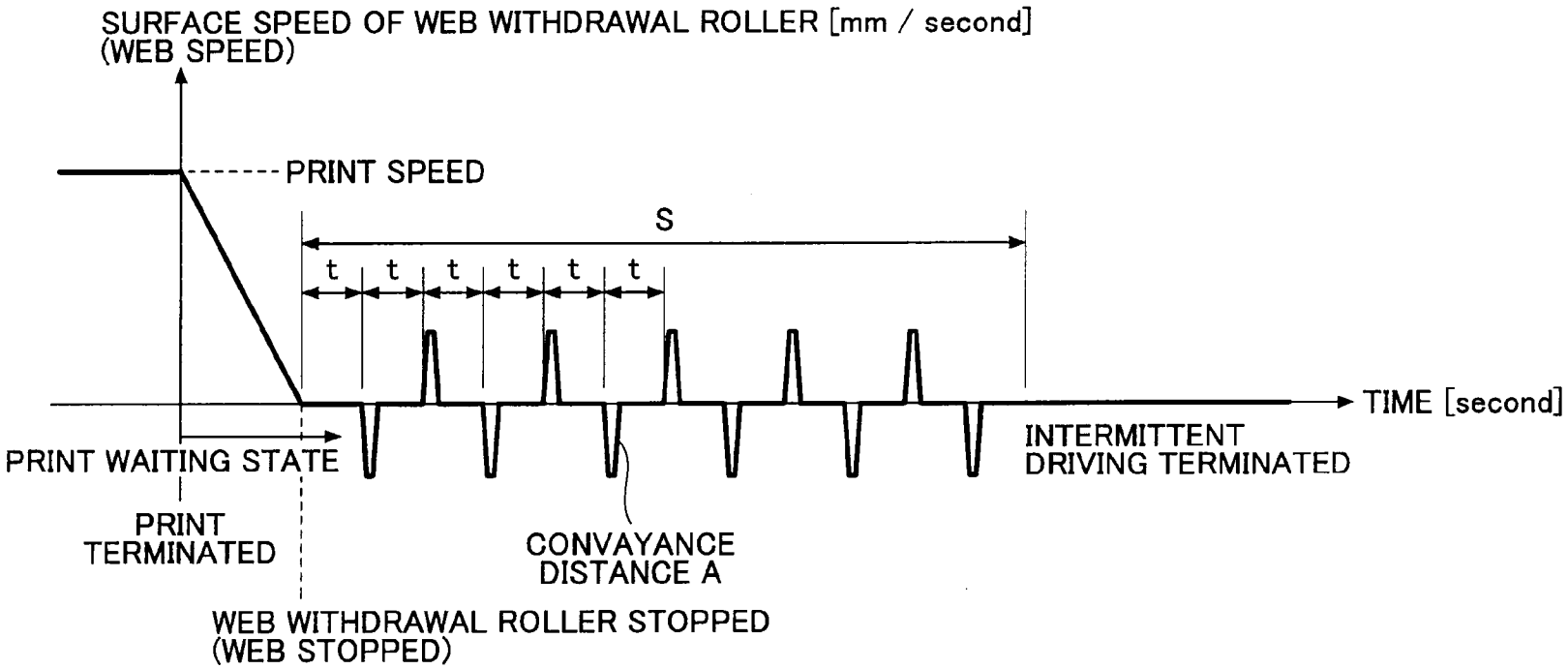
FIG. 10 is a diagram illustrating a time S at which an intermittent driving is terminated.

Hereinafter, a method of setting a trigger to terminate the intermittent driving during the print waiting state is explained. FIG. 10 is a diagram illustrating a time S at which the intermittent driving is terminated. Here, the horizontal axis in FIG. 10 indicates a time [second], and the vertical axis in FIG. 10 indicates a surface speed [mm/second] of the web withdrawal roller 51. Further, FIG. 11 is a diagram showing the printing apparatus including the controller and the input unit.

Figure 11:
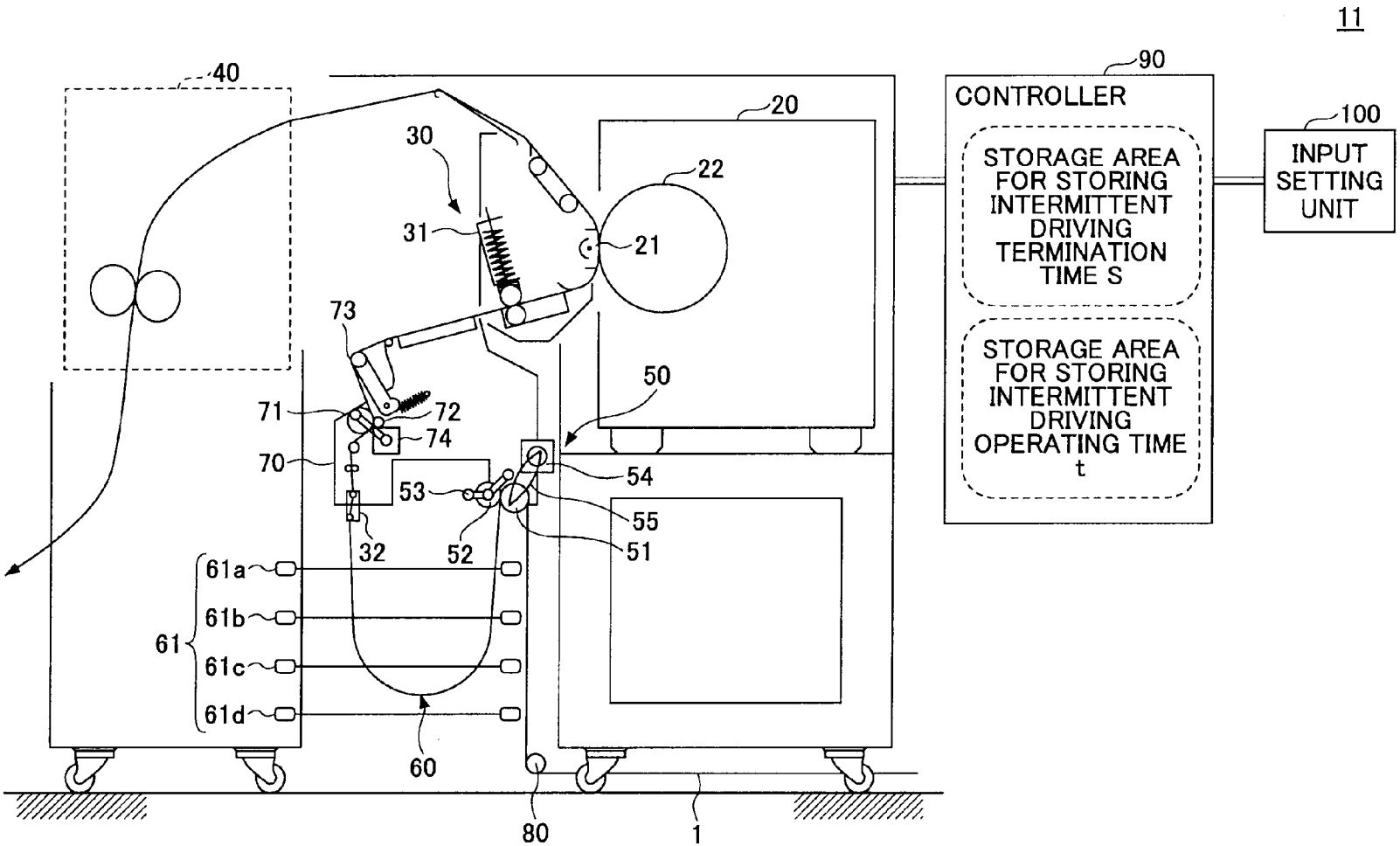
FIG. 11 is a diagram showing the printing apparatus with a controller and an input unit.

The printing apparatus 11 shown in FIG. 11 is configured such that the controller 90 and the input setting unit 100 are included in the printing apparatus 10 shown in FIG. 1. Here, the controller 90 shown in FIG. 11 may include a control unit for controlling operations of the printing apparatus 11 and a storage unit, such as memory. The memory includes, for example, a storage area for storing the intermittent driving termination time S and a storage area for storing the intermittent driving time t. Further, the input setting unit 100 includes, for example, a touch panel. With the input setting unit 100, various types of information may be arbitrary set and an instruction may be input through a predetermined screen that is displayed on the input setting unit 100.

In the embodiment, as shown in FIG. 10, the time at which the intermittent driving of the web withdrawal roller 51 is terminated is defined to be S in advance. When the user inputs a value corresponding to the intermittent driving termination time S using the input setting unit 100, the information about the value is stored in the storage area for storing the intermittent driving termination time S included in the controller 90. In the embodiment, the printing apparatus 10 may include only the controller 90. In such a case, a predetermined value of the intermittent driving termination time S is stored in the storage area for storing the intermittent driving termination time S.

With the above configuration, as shown in FIG. 10, the intermittent driving is terminated at the time when the time period S is elapsed from the time at which the web withdrawal roller 51 was stopped. In this manner, the amount of the deformation of the web 1 is regulated within the range where the printing apparatus 10 is able to print normally. At the same time, the unnecessary power consumption is cut down in a right condition for a usage of the printing apparatus 10. Therefore, the occurrence of the defects on the transfer of the image onto the web 1 can be suppressed, and the degradation of the printing quality can be reduced.

Additionally, in the embodiments, not only the intermittent driving termination time S but also the intermittent driving time t can be set. Further, a value of the intermittent driving time t, which has been set, is stored in the storage area for storing the intermittent driving time t. With the above configuration, the optimum value of the intermittent driving time t can be set, depending on the stiffness of the web 1 to be used and the pressing forces of the pressing rollers 52. In this manner, the amount of the deformation of the web 1 can be regulated within the range where the printing apparatus 10 is able to print normally, and the occurrence of the defects on the transfer of the image onto the web 1 is suppressed. Therefore, the degradation of the printing quality can be reduced.

Further, the controller 90 in FIG. 11 may include a drive control unit for causing the web withdrawal roller 51 to be driven intermittently. In such a case, the web 1 is intermittently driven, when the web withdrawal roller 51 is intermittently driven in the print waiting state, while the pressing forces from the pressing rollers 52 are maintained, as shown in FIGS. 3-10.

Further, in the examples of the above-described figures, the first intermittent driving is started t seconds after the web withdrawal roller 51 was stopped. Similarly, the time period between the start time of the nth intermittent driving and the start time of the (n+1)th intermittent driving is shown as t seconds in the figures. The time period t is explained as "the time period of t seconds during which the web 1 is pressed by the pressing rollers 52 at the corresponding areas." This is because the driving time corresponding to the conveyance distance A (or B, or C) is sufficiently small. Here, the value of the intermittent driving time is set to be t seconds. However, the value of the intermittent driving time may be a different value, provided that the value is less than t seconds.

<Experimental Results Regarding Duration Time and Defects on Transfer>

Figure 12:
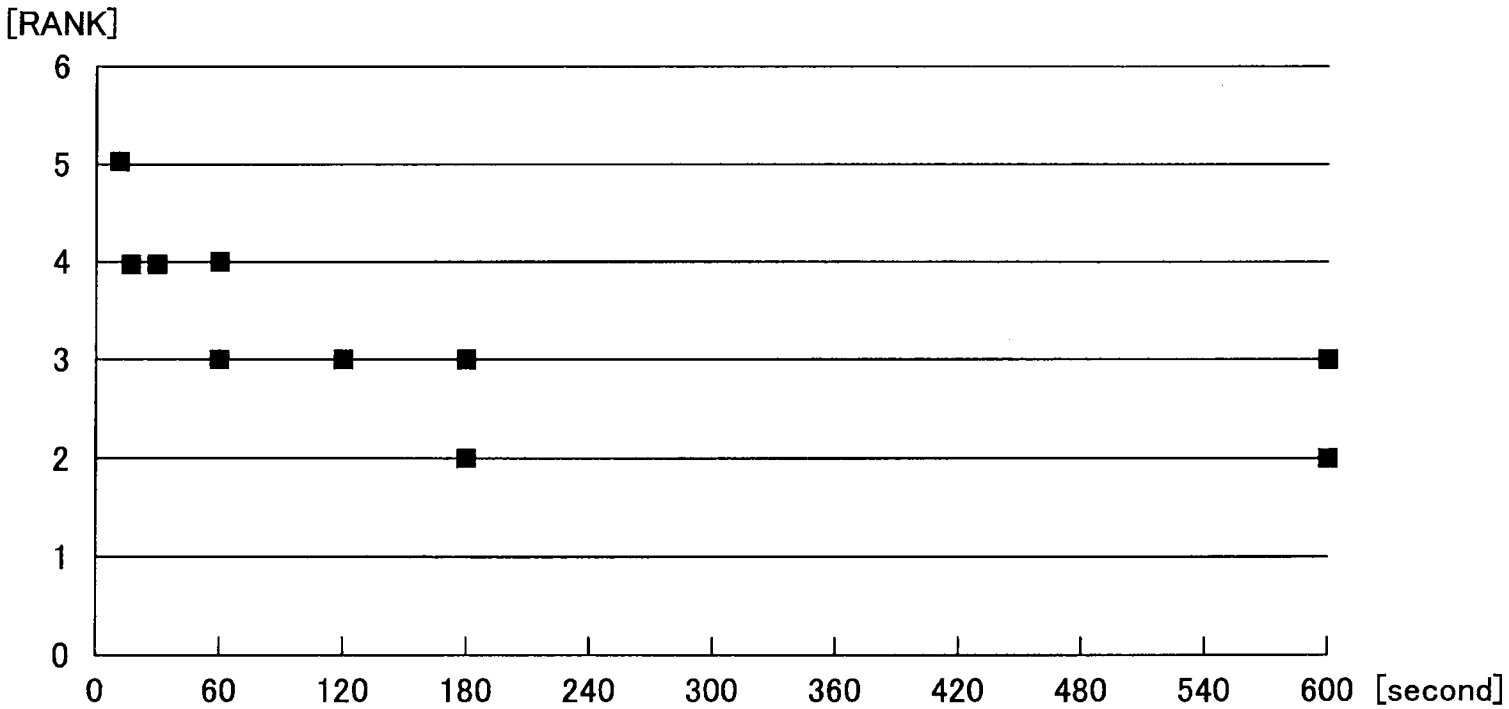
FIG. 12 is a diagram showing results of experiments regarding duration times and defects on transfer of an image, in a coated cardboard.

Hereinafter, experimental results regarding duration time (pressing time) and defects on the transfer are explained using FIG. 12. FIG. 12 is a diagram showing results of the experiments regarding the duration time and the defects on the transfer of an image, in a coated cardboard. Here, FIG. 12 shows a relationship between the duration time and the defect on the transfer of the image in the coated cardboard. The horizontal axis indicates a time [second], and the vertical axis indicates a percentage of missing transfer portions (white splotches) [rank] in areas R, which are pressed by the pressing rollers 52.

In the experiments, the coated cardboard was loaded and the coated cardboard was pressed with the pressing rollers 52. Then the pressing time was measured. After that, the areas R (for example, each area R is 16 mm×7 mm), which were pressed by the pressing rollers 52, were marked so that the areas R could be identified. Solid printing was performed on the entire area, which included the marked areas R, of the printing paper. The quality of the solid printing in the marked areas R (namely, whether the missing transfer portions exist or nor) was determined by visual comparison using a rank reference sheet for the solid printing. Here, the determination of the quality of the transfer may be performed accordingly in the following manner, in addition to the visual comparison. Namely, the solid printing is read using a reflection sensor and the solid printed area is quantified. Then the quantified solid printed area is compared with the reference.

Further, the ranks 1-6 indicated along the vertical axis in FIG. 12 show the ranks of the missing transfer. The rank 4 and higher are the allowable levels of the missing transfer in the printing apparatus. The percentage of the missing transfer portions becomes higher as the rank goes down.

As shown in FIG. 12, when the coated cardboard is used, the rank of the missing transfer is greater than or equal to the rank 4, which is an allowable level of the missing transfer, if the pressing time is shorter than or equal to 30 seconds. Therefore, in the embodiment, when the above-described coated cardboard is used, the intermittent driving time t is set to be less than or equal to 30 seconds.

Namely, in the embodiments, the intermittent driving time t is set based on a thickness of the web 1, stiffness of the web 1, a type of the web 1, and the pressing forces of the pressing rollers 52. In this manner, the occurrence of the defects on the transfer of the image onto the web 1 is suppressed, and the degradation of the printing quality can be reduced.

Further, in the above-described setting, for example, a table which lists the values of the intermittent driving time t corresponding to parameter values may be prepared, based on the experimental results or the results of the evaluations that have been obtained in advance. Here, each parameter value includes the thickness of the web 1, the stiffness of the web 1, the type of web 1, and the pressing forces of the pressing rollers 52. In such a case, for example, the printing apparatus may be configured such that the intermittent driving time t is set and stored in the storage area for storing the intermittent driving time t, when the user input the above-described parameter using the input setting unit 100.

Figure 13:
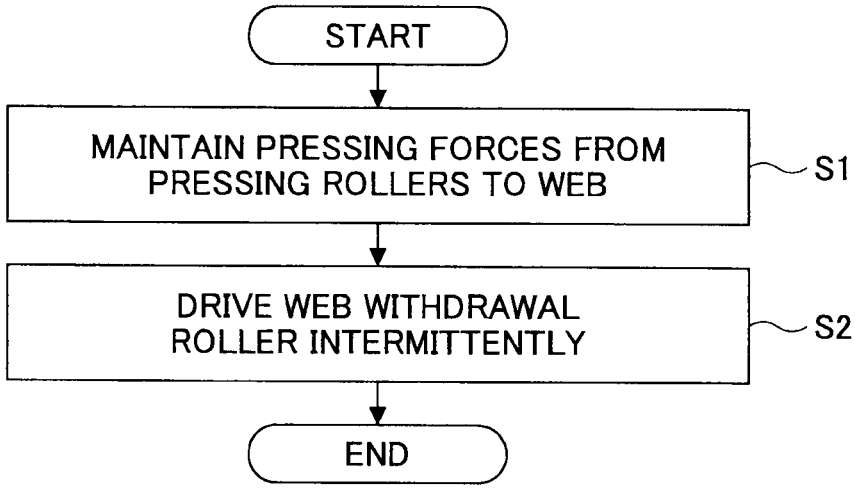
FIG. 13 is a flowchart illustrating a method of intermittently conveying the web in the printing apparatus.

FIG. 13 is a flowchart illustrating a method of intermittently conveying the web 1 in the printing apparatus 10 during a print waiting state of the printing apparatus 10. Here, the method includes a step of maintaining the pressing forces from the pressing rollers 52 to the web 1 (a step S1), and a step of intermittently driving the web withdrawal roller 51 (a step S2). Thus, the web 1 is intermittently conveyed.

As described above, in the embodiments, the deformation of the web 1 by the pressing rollers during the print waiting state is suppressed, while the web 1 is prevented from being dropped. Therefore, the degradation of the printing quality can be reduced. Further, as a modified example, a pressing member which presses the web (printing paper) may be moved with respect to the web. In the above embodiments, the following configuration is explained. Namely, the pressing rollers 52 are used as the pressing member, and the web 1 is moved with respect to the pressing rollers 52. However, the embodiments are not limited to this configuration. For example, the pressing member may be moved with respect to the web 1, instead of moving the web 1. Specifically, a ball-shaped pressing roller may be used, for example, as the pressing member. The ball-shaped pressing roller is movably supported in a housing-type holder. The housing-type holder is pressed by a spring. Further, the housing-type holder is secured to a rod. By using a link structure or the like, the ball-shaped pressing roller is moved in the width direction of the web 1. Here, the above configuration may be modified. For example, the ball-shaped pressing roller is slidably attached to a shaft, and the ball-shaped pressing roller is moved in the width direction of the web 1.

In the above description, the embodiments of the present invention are concretely explained. However, the present invention is not limited to the specifically disclosed embodiments, and variations and modifications may be made without departing from the scope of the present invention.

The present application is based on Japanese Priority Application No. 2010-288709 filed on Dec. 24, 2010, the entire contents of which are hereby incorporated herein by reference.

What is claimed is:

1. A printing apparatus, capable of regulating a deformation of a web when the web is held during a print waiting state, comprising:

a web conveyance unit configured to convey the web;

a printing unit configured to print an image on the web;

a web discharging unit configured to discharge the web, on which the image is formed with the printing unit, the web discharging unit being placed downstream of the printing unit;

a web withdrawal unit configured to withdraw the web into the printing apparatus, the web withdrawal unit including a web withdrawal roller and at least one pressing roller;

a web suspending unit configured to suspend a portion of the web in between the web withdrawal unit and the web conveyance unit; and a web amount detecting unit configured to detect an amount of the portion of the web, wherein, when the printing apparatus is in the print waiting state, the printing apparatus drives the web withdrawal roller intermittently, while a pressing force from the at least one pressing roller to the web is maintained, so as to convey the web in a first direction in which the web is conveyed during a printing operation or to convey the web in a second direction which is opposite to the first direction, and a direction the web is conveyed is switched based on the amount of the portion of the web.

2. The printing apparatus according to claim 1, wherein, when the amount of the portion of the web reaches a predetermined amount, the printing apparatus terminates driving the web withdrawal roller intermittently.

3. The printing apparatus according to claim 1, wherein when a predetermined time is elapsed from a time the print waiting state of the printing apparatus starts, the printing apparatus terminates driving of the web withdrawal roller intermittently.

4. The printing apparatus according to claim 3, further comprising an input setting unit configured to set at least one of the predetermined time for terminating driving the web withdrawal roller intermittently and an interval for driving the web withdrawal roller intermittently.

5. The printing apparatus according to claim 1, wherein the at least one pressing roller is configured to maintain the pressing force to be constant for a plurality of types of webs having different respective thicknesses.

wherein an amount of the pressing force corresponds to a respective thickness.

6. The printing apparatus according to claim 1, further comprising an input setting unit configured to set an interval for driving the web withdrawal roller intermittently.

7. A method of intermittently conveying a web in a printing apparatus during a print waiting state of the printing apparatus and regulating a deformation of the web when the web is held during the print waiting state, wherein the printing apparatus includes a web conveyance unit configured to convey the web, a printing unit configured to print an image on the web, a web discharging unit configured to discharge the web, on which the image is formed with the printing unit, the web discharging unit being placed downstream of the printing unit, a web withdrawal unit configured to withdraw the web into the printing apparatus, the web withdrawal unit including a web withdrawal roller and at least one pressing roller, a web suspending unit configured to suspend a portion of the web in between the web withdrawal unit and the web conveyance unit, and a web amount detecting unit configured to detect an amount of the portion of the web, wherein the method comprises:

maintaining a pressing force from the at least one pressing roller to the web;

conveying the web in a first direction in which the web is conveyed during a printing operation or conveying the web in a second direction that is opposite to the first direction;

detecting the amount of the portion of the web; and switching a direction the web is conveyed based on the amount of the portion of web.

* * * * *